US009912049B2

(12) United States Patent
Chang et al.

(10) Patent No.: US 9,912,049 B2
(45) Date of Patent: Mar. 6, 2018

(54) ANTENNA STRUCTURE AND ELECTRONIC DEVICE HAVING SAME

(71) Applicant: Chiun Mai Communication Systems, Inc., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 322 days.

(21) Appl. No.: 14/527,127

(22) Filed: Oct. 29, 2014

(65) Prior Publication Data

US 2016/0111789 A1 Apr. 21, 2016

(30) Foreign Application Priority Data

Oct. 15, 2014 (CN) ..... 2014 1 0544108

(51) Int. Cl.

| | |
|---|---|
| ***H01Q 1/48*** | (2006.01) |
| ***H01Q 1/24*** | (2006.01) |
| ***H01Q 9/04*** | (2006.01) |
| ***H01Q 9/42*** | (2006.01) |
| ***H01Q 5/00*** | (2015.01) |
| ***H01Q 5/371*** | (2015.01) |

(52) U.S. Cl.

CPC ..... *H01Q 1/48* (2013.01); *H01Q 1/243* (2013.01); *H01Q 5/371* (2015.01); *H01Q 9/0442* (2013.01); *H01Q 9/42* (2013.01)

(58) Field of Classification Search

CPC .... H01Q 9/0407; H01Q 5/371; H01Q 9/0442; H01Q 9/42

See application file for complete search history.

(56) References Cited

U.S. PATENT DOCUMENTS

| | | | | |
|---|---|---|---|---|
| 6,552,686 | B2 * | 4/2003 | Ollikainen | H01Q 1/243 343/700 MS |
| 2008/0316115 | A1 * | 12/2008 | Hill | H01Q 1/243 343/702 |
| 2012/0139792 | A1 * | 6/2012 | Pan | H01Q 1/243 343/700 MS |
| 2012/0229347 | A1 * | 9/2012 | Jin | H01Q 1/243 343/702 |
| 2013/0271341 | A1 * | 10/2013 | Lin | H01Q 1/243 343/860 |

* cited by examiner

*Primary Examiner* — Daniel J Munoz

(74) *Attorney, Agent, or Firm* — ScienBiziP, P.C.

(57) ABSTRACT

A dual-band Wi-Fi antenna structure includes a metallic middle frame of a casing of a handheld electronic device, a grounding plane received in the middle frame, an antenna body connected to the grounding plane, and an adjusting element. The grounding plane defines a rectangular recess in a corner thereof. The antenna body has a radiation patch having a part located over the recess. The adjusting element is located in the recess. An effective length of the recess is adjustable by adjusting a parameter of the adjusting element, which is a coefficient of self-inductance when the adjusting element is an adjustable inductor. By adjusting the effective length of the recess, a resonant frequency of the antenna structure at a low frequency band is adjustable, while a resonant frequency thereof at a high frequency band is not altered.

24 Claims, 6 Drawing Sheets

ANTENNA STRUCTURE AND ELECTRONIC DEVICE HAVING SAME

CROSS-REFERENCE TO RELATED APPLICATION

This application claims priority to Chinese Patent Application No. 201410544108.7 filed on Oct. 15, 2014 in the China. Intellectual Property Office, the contents of which are incorporated by reference herein.

FIELD

The present disclosure relates to an antenna structure and an electronic device having the antenna structure, and particularly to a dual-band antenna structure and a handheld electronic device having the dual-band antenna structure.

BACKGROUND

Following the development of wireless communication technology, more and more electronic devices have wireless communication capability. Furthermore, such electronic devices are made more and more compact so that they can easily carried by users thereof. The miniaturization of the electronic device induces the use of metal for manufacturing the casing thereof, which is more strong and durable and can quickly dissipate heat generated by components of the electronic device. However the metallic casing forms a barrier for radiation of wireless signals emitted from antennas of the electronic device, thereby hindering wireless connections between the antennas of the electronic device and other electronic devices.

The metallic casing of the electronic device is generally divided into a cover, a base and a middle frame interconnecting the cover and the base. Generally, global positioning system (GPS) antenna, dual-band Wi-Fi (BT/Wi-Fi) antenna and diversity (DIV) antenna are provided at an upper part of the base, while a main antenna for mobile phone communication, i.e., main cellular antenna is provided at a lower portion of the base. The crowded arrangement of the three antennas, i.e., the GPS antenna, the DIV antenna and the BT/Wi-Fi antenna at the upper portion of the base is adverse to antenna design, manufacturing and tuning.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present antenna structure and electronic device having the antenna structure. Moreover, in the drawings, like reference numerals designate corresponding parts throughout the several views.

DETAILED DESCRIPTION

Figure 1:
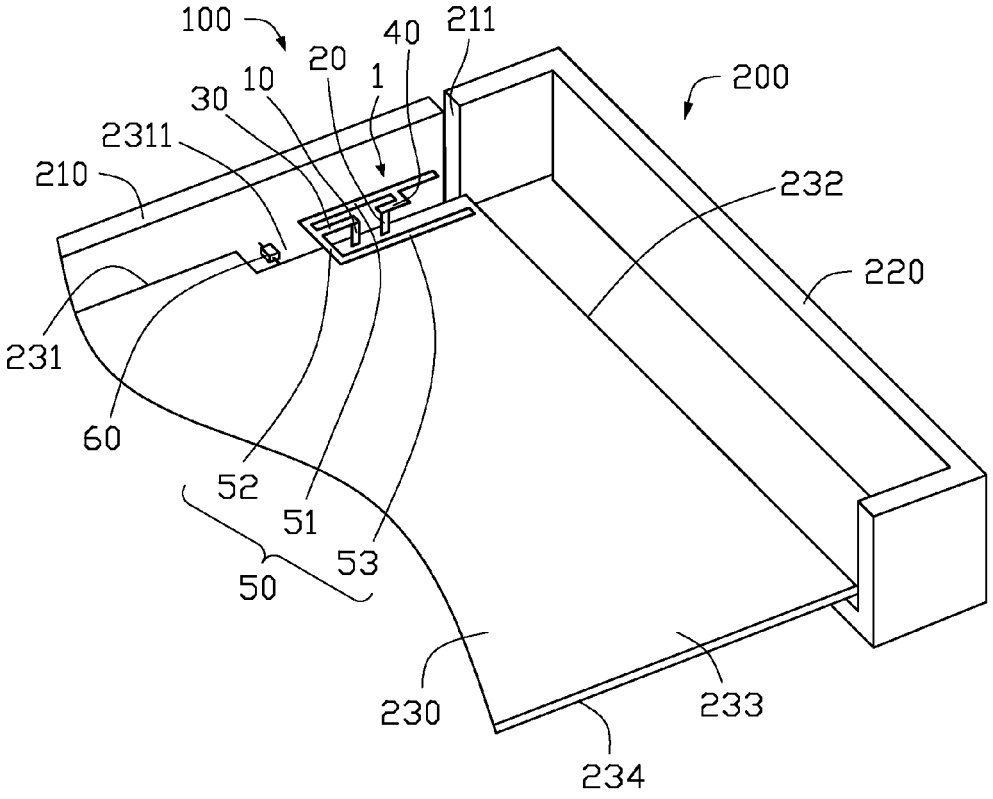
FIG. 1 is a perspective view of an antenna structure in accordance with the present disclosure, which is located at a metallic middle frame of a casing of a handheld electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
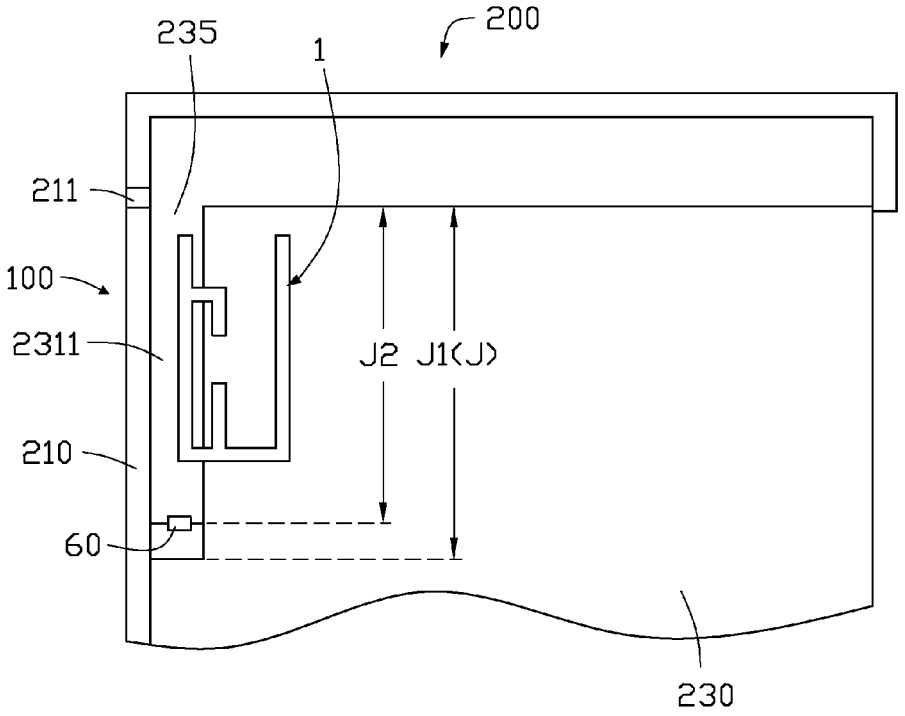
FIG. 2 is a top view of the antenna structure of FIG. 1.

Referring to FIGS. 1 and 2, an antenna structure 100 is shown which is used in a handheld electronic device such as a mobile phone, particularly a smart phone, which has a casing with a metallic base (not shown), a metallic cover (not shown) and a metallic middle frame 200 interconnecting the metallic base and the metallic cover. A main cellular antenna (not shown) is provided at a lower part of the metallic base, a GPS antenna and a DIV antenna are provided at an upper part of the metallic base of the casing of the handheld electronic device. The antenna structure 100 is used for transmission and receipt of Wi-Fi wireless signals under two bands, i.e., a low frequency band of 2.4 GHz and a high frequency band of 5.15-5.85 GHz. In other words, the antenna structure 100 in accordance with the present disclosure is a dual-band Wi-Fi antenna.

The metallic middle frame 200 includes at least a first side wall 210 and at least a second side wall 220 connecting with and substantially perpendicular to the first side wall 210. The second side wall 220 is a top wall of the metallic middle frame 200. A grounding plane 230, which is made of a printed circuit board (PCB), is conformably mounted in the metal middle frame 200. Alternatively, the grounding plane 230 can be made of metal core printed circuit board (MCPCB). The grounding plane 230 has a first side 231 adjacent and parallel to the first side wall 210, and a second side 232 near and parallel to the second side wall 220. The grounding plane 230 has a substantially rectangular shape, wherein the second side 232 is neighboring and perpendicular to the first side 231. The grounding plane 230 further has a first face 233 facing the metallic base of the casing of the handheld electronic device and a second face 234 facing the metallic cover thereof. A first rectangular recess 2311 is provided in a top, left corner of the grounding plane 230, which is elongated along a lengthwise direction of the grounding plane 230. A second rectangular recess 211 is defined in the first side wall 210, extending from a top to a bottom thereof and at a location near the second side 232 (i.e., top side) of the grounding plane 230. The second rectangular recess 211 is substantially perpendicular to the first rectangular recess 2311 and communicates therewith via a top opening 235 of the first rectangular recess 2311.

The antenna structure 100 includes an antenna body 1, which is located over the top, left corner of the grounding plane 230, with a left part of the antenna body 1 being located over the first rectangular recess 2311 and extending therealong. The antenna body 1 is a planar inverted-F antenna (PIFA). The antenna body 1 includes a feed section 10, a grounding section 20, a first connection section 30, a second connection section 40 and a radiation patch 50 having a substantially U-shaped profile. The radiation patch 50 is positioned in a first plane substantially parallel to and spaced from the grounding plane 230, and the radiation patch 50 is suspended above the grounding plane 230. The feed and grounding sections 10, 20 are positioned in a second plane substantially perpendicular to the grounding plane 230 and electrically coupled thereto. The radiation patch 50 includes a first radiation section 51, a second radiation section 52 and a third radiation section 53 successively connecting with each other, wherein the second radiation section 52 interconnects ends of the first and third radiation sections 51, 53 away from the second side 232 of the grounding plane 230 while is parallel to the second side 232. The first and third radiation sections 51, 53 are parallel to the first side 231 of the grounding plane 230, wherein the first radiation section 51 is suspended over the first rectangular recess 2311 and the third radiation section 53 is located inside the first radiation section 51 and above the grounding plane 230. The feed and grounding sections 10, 20 are located in a region defined by the radiation patch 50, wherein the grounding section 20 is located nearer to the second side 232 than the feed section 10. The first connection section 30 is straight and connects a top end of the feed section 10 with the second radiation section 52. A bottom end of the feed section 10 is connected to a transceiver circuit (not shown). The second connection section 40 is L-shaped and connects a top end of the grounding section 20 with the first radiation section 51. A bottom end of the grounding section 20 is connected to a grounding circuit (not shown). The first and section connection sections 30, 40 are coplanar with the radiation patch 50 and positioned in the first plane.

The antenna structure 100 further comprises an adjusting element 60 which is located in the first rectangular recess 2311 and provided for adjusting resonant frequency of the antenna structure 100. The adjusting element 60 has an outer side electrically coupled to the first side wall 210 of the metallic middle frame 200, and an inner side electrically coupled to the grounding plane 230. The adjusting element 60 can be an adjustable inductor, an adjustable capacitor, an adjustable resistor or a combination thereof. In the preferred embodiment, the adjusting element 60 is an adjustable inductor. A distance J2 between the second side 232 of the grounding plane 230 and the electrical connection of the adjusting element 60 with the grounding plane 230 is shorter than a length J1 (i.e., actual length) of the first rectangular recess 2311. When the coefficient of self-inductance of the adjusting element 60 approaches infinity, to any radio frequency, the adjusting element 60 between its connections with the metallic middle frame 200 and the grounding plane 230 is equivalent to an open circuit, whereby an effective length J of the first rectangular recess 2311 is equal to the actual length J1 of the first rectangular recess 2311. On the other hand, when the coefficient of self-inductance of the adjusting element 60 approaches zero, to any radio frequency, the adjusting element 60 between its connections with the metallic middle frame 200 and the grounding plane 230 is equivalent to a short circuit, whereby the effective length J of the first rectangular recess 2311 is equal to the length J2 between the second side 232 and the connection between the adjusting element 60 and the grounding plane 230. Accordingly, by adjusting the coefficient of self-inductance of the adjusting element 60, the effective length J of the first rectangular recess 2311 is adjustable between the length J2 and the actual length J1.

Figure 3:
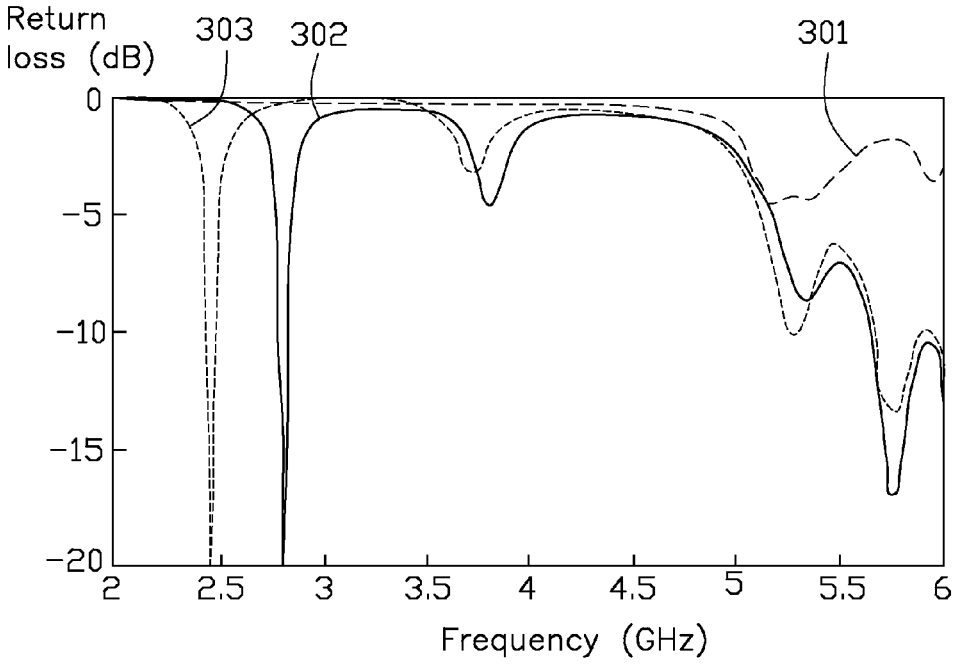
FIG. 3 is a graph showing return losses of the antenna structure of FIG. 1 at different assumed conditions.
Figure 4:
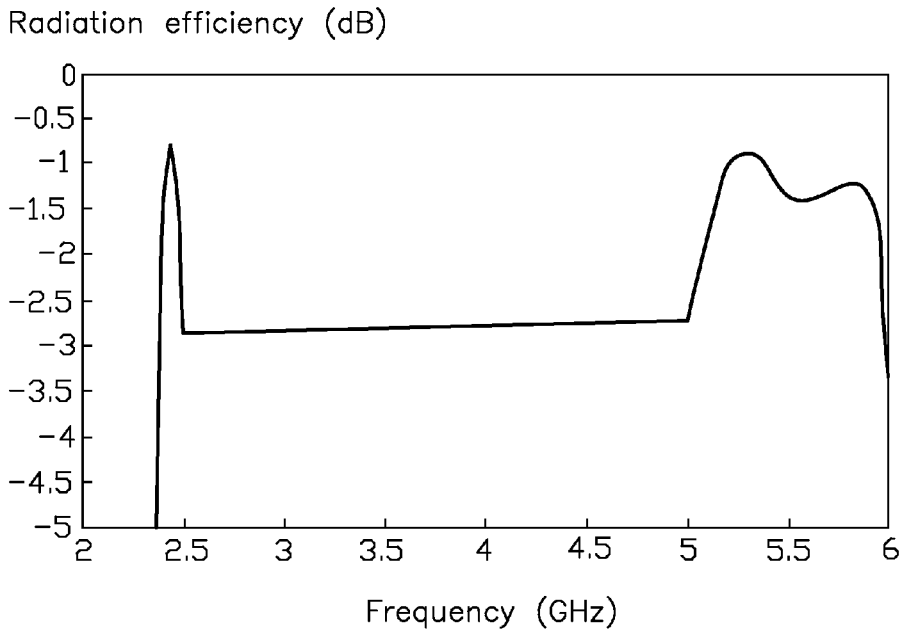
FIG. 4 is a graph showing a radiation efficiency of the antenna structure of FIG. 1 at a further different assumed condition.

Referring to FIGS. 3 and 4, when the adjusting element 60 is omitted and the actual length J1 of the first rectangular recess 2311 is set to be 0 mm, 16 mm or 20 mm, the return loss of the antenna structure 100 is respectively indicated by curve 301, curve 302 or curve 303 shown in FIG. 3. When the first rectangular recess 2311 is set to be 0 mm, the first side 231 of the grounding plan 230 totally connects with the first side wall 210 of the metallic middle frame 200, whereby a bottom side of the radiation patch 50 is totally covered by the grounding plane 230. Under this situation, input impedance is not matched, and the antenna structure 100 can have a resonant mode only at 5-6 GHz, as indicated by curve 301, which cannot satisfy the resonant mode of the dual band Wi-Fi communication. From FIG. 3, it can be seen that by providing the first rectangular recess 2311 and adjusting its actual length J1, an additional resonant mode at a low frequency band, i.e., 2-3 GHz, can be obtained. During the adjustment of the actual length J1 of the first rectangular recess 2311 from 16 mm to 20 mm, the antenna structure 100 can have resonant modes at both the low frequency band, i.e., 2-3 GHz, and the high frequency band, i.e., 5.15-5.85 GHz. By fine adjustment of the actual length J1 of the first rectangular recess 2311, the antenna structure 100 can obtain input impedance matching at high frequency band. FIG. 4 shows the radiation efficiency of the antenna structure 100 when the actual length J1 of the first rectangular recess 2311 is 20.35 mm.

Figure 5:
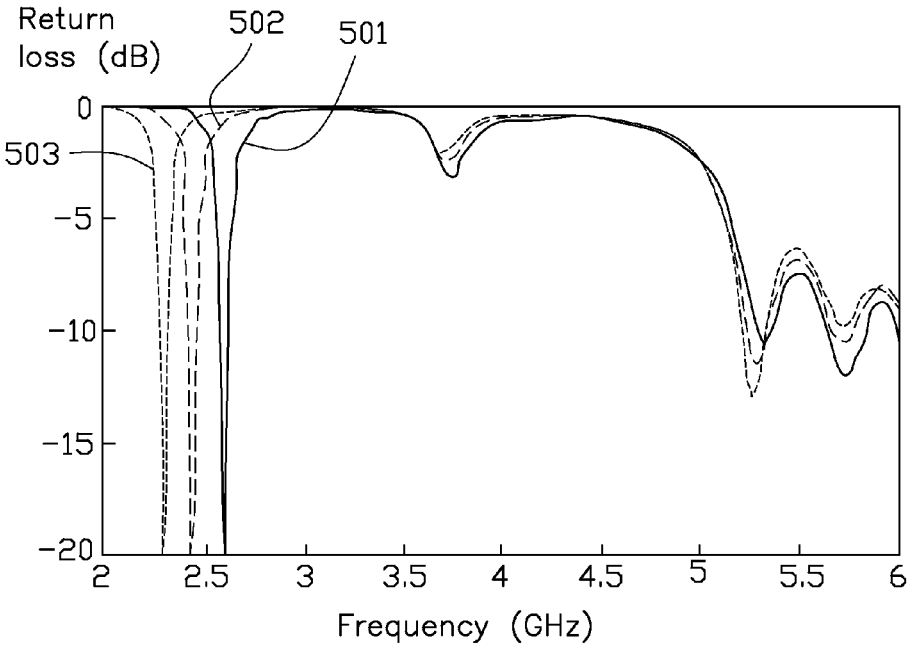
FIG. 5 is a graph showing return losses of the antenna structure of FIG. 1 at still different assumed conditions.
Figure 6:
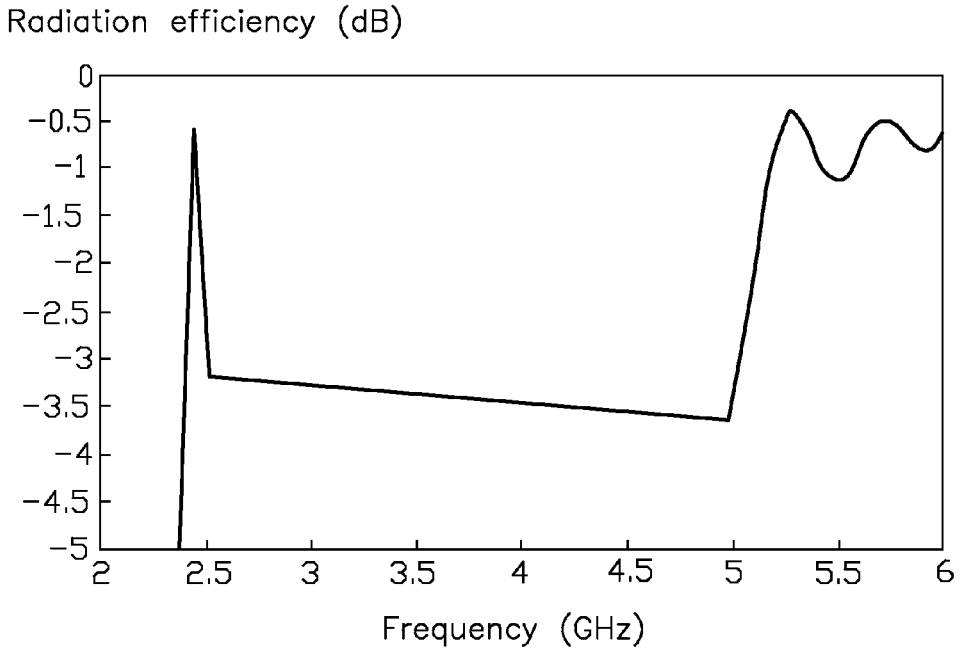
FIG. 6 is a graph showing a radiation efficiency of the antenna structure of FIG. 1 which has parameters thereof adjusted to enable the antenna structure to satisfy dual-band Wi-Fi communication requirements.

Referring to FIGS. 5 and 6, when the actual length J1 is equal to 30 mm and the length J2 between the connection of the adjusting element 60 and the grounding plan 230 and the second side 232 of the grounding plane 230 is equal to 15 mm, and when the adjusting element 60, which is an adjustable inductor, has a coefficient of self-inductance which is respectively 0.5 nH (nanohenry), 2.5 nH and 6.5 nH, the return loss of the antenna structure 100 is respectively indicated by curve 501, curve 502 and curve 503 in FIG. 5. From FIG. 5, it can be seen that when the coefficient of self-inductance of the adjusting element 60 is increased from 0.5 nH to 6.5 nH, the resonant frequency of the antenna structure 100 at low frequency band is reduced from 2.6 GHz (gigahertz) to 2.3 GHz, while the resonant frequency of the antenna structure 100 at high frequency band is unchanged. Meanwhile, it can be seen that when the coefficient of self-inductance of the adjusting element 60 is 2.5 nH, the resonant frequency of the antenna structure 100 at low frequency band is substantially equal to 2.4 GHz, which meets the requirement of the frequency resonant of the dual band Wi-Fi communication at low frequency band. FIG. 6 shows the radiation efficiency of the antenna structure 100 when the actual length J1 of the first rectangular recess 2311 is 30 mm, the length J2 is 15 mm and the coefficient of self-inductance of the adjusting element 60 is 2.6 nH.

By providing the first rectangular recess 2311 between the first side 231 of the grounding plane 230 and the first side wall 210 of the metallic middle frame 200, the parts of the first side wall 210 and the first side 231 adjacent to the first rectangular recess 2311 can function as a part of a resonant loop of the antenna structure 100, whereby the input impedance of the antenna structure 100 at high frequency band can be matched. By providing the adjusting element 60 in the first rectangular recess 2311 and by adjusting a parameter of the adjusting element 60, an effective length of the first rectangular recess 2311 can be adjusted, whereby the input impedance of the antenna structure 100 at low frequency band can be matched under the condition that the resonant frequency of the antenna structure 100 at high frequency band is not necessary to be altered. Accordingly, the antenna structure 100 in accordance with the present disclosure can meet the requirements of dual-band Wi-Fi communication: being resonant at both the low frequency band, i.e., 2.4 GHz and the high frequency band, i.e., 5.15-5.85 GHz. Meanwhile, by the provision of the adjusting element 60, the effective length J of the first rectangular recess 2311 can be adjusted, which avoids the repeated adjustment of the actual length J1 of the first rectangular recess 2311 during the test of the antenna structure 100; thus, the present disclosure can effectively lower the manufacturing cost of the antenna structure 100.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An electronic device with a dual-band antenna structure comprising:

a metallic middle frame, the metallic middle frame including a first side wall and a second side wall connected to, and substantially perpendicular to, the first side wall;

a grounding plane configured to be received into the middle frame, the grounding plane having:

a first side edge, having a first portion and a second portion;

a second side edge substantially perpendicular to both the first portion and second portion of the first side edge; and a first face substantially perpendicular to the first side edge and to the second side edge;

wherein, when the grounding plane is received into the middle frame:

the first portion and second portion of the first side edge are substantially parallel to the first side wall and the second portion of the first side edge is substantially adjacent the first side wall; and the second edge of the grounding plane is substantially parallel to the second side wall and positioned substantially near the second side wall; and wherein, the first portion of the first side edge, the first side wall and the second side wall cooperate to define a recess in the grounding plane and creating a recess space extending from the grounding plane with sides substantially perpendicular to the first face of the grounding plane; and an antenna body electrically coupled to the grounding plane and having a radiation patch, the radiation patch positioned in a first plane substantially parallel to and spaced from the grounding plane, and the radiation patch suspended above the first face with at least a portion of the radiation patch extending into the recess space;

wherein the antenna body comprises a feed section connecting with the grounding plane, a grounding section connecting with the grounding plane, a first connection section connecting with the feed section, a second connection section connecting with the grounding section;

wherein the radiation patch comprises a first radiation section, a second radiation section and a third radiation section successively connecting with each other;

wherein the first radiation section, the second radiation section, the third radiation section, the first connection section, and the second connection section are coplanar;

wherein the first connecting section is spaced from the first radiation section and the third radiation section, and positioned between the first radiation section and the third radiation section; an end of the first connecting section is perpendicularly connected to the second radiation section, and another end of the first connecting section is spaced from the second connecting section.

2. The dual-band antenna structure of claim 1, further comprising an adjusting element received in the recess and electrically coupling with the metallic middle frame and the grounding plane, a resonant frequency of the dual-band antenna structure being adjusted by adjusting a parameter of the adjusting element.

3. The dual-band antenna structure of claim 2, wherein the adjusting element is an adjustable inductor and the parameter is a coefficient of self-inductance of the adjustable inductor.

4. The dual-band antenna structure of claim 1, wherein the antenna body is a planar inverted-F antenna.

5. The dual-band antenna structure of claim 4, wherein the radiation patch connecting with the first and second connecting sections, the radiation patch having a substantially U-shaped profile, the feed and the grounding sections are positioned in a second plane substantially perpendicular to the grounding plane.

6. The dual-band antenna structure of claim 5, wherein the grounding plane is substantially rectangular and the recess is rectangular and defined in neighboring first and second sides of the grounding plane, the first and third radiation sections being parallel to the first side of the grounding plane, the second radiation section being parallel to the second side of the grounding plane and interconnecting ends of the first and third radiation sections away from the second side of the grounding plane.

7. The dual-band antenna structure of claim 6, wherein the first radiation section is suspended above the recess and extends along a lengthwise direction of the recess.

8. The dual-band antenna structure of claim 7, wherein the dual-band antenna structure has a first resonant frequency at a low frequency band of 2.4 GHz and a second resonant frequency at a high frequency band of 5.15-5.85 GHz.

9. The dual-band antenna structure of claim 8, wherein the dual-band antenna structure is configured for Wi-Fi communication.

10. The dual-band antenna structure of claim 7, further comprising an adjustable inductor located in the recess and electrically coupled to the metallic middle frame and the grounding plane, a distance between the second side of the grounding plane and the adjustable inductor is 15 mm, a length of the recess is 30 mm and a coefficient of self-inductance of the adjustable inductor is 2.6 nH.

11. An handheld electronic device, comprising:

a casing having a substantially rectangular metallic middle frame;

a substantially rectangular grounding plane received in the metallic middle frame, defining a recess in one of two top corners thereof; and a planar inverted-F antenna for dual-band Wi-Fi communication having a feed section and a grounding section substantially perpendicularly connected to the grounding plane, and a substantially U-shaped radiation patch connected to the feed and grounding sections;

wherein the radiation patch is positioned in a first plane substantially parallel to and spaced from the grounding plane, and the radiation patch is suspended above the grounding plane and has at least a section located over the recess, the feed and the grounding sections are positioned in a second plane substantially perpendicular to the grounding plane;

wherein the antenna body comprises a feed section connecting with the grounding plane, a grounding section connecting with the grounding plane, a first connection section connecting with the feed section, a second connection section connecting with the grounding section;

wherein the radiation patch comprises a first radiation section, a second radiation section and a third radiation section successively connecting with each other;

wherein the first radiation section, the second radiation section, the third radiation section, the first connection section, and the second connection section are coplanar;

wherein the first connecting section is spaced from the first radiation section and the third radiation section, and positioned between the first radiation section and the third radiation section; an end of the first connecting section is perpendicularly connected to the second radiation section, and another end of the first connecting section is spaced from the second connecting section.

12. The handheld electronic device of claim 11, further comprising an adjusting element located in the recess and electrically coupling with the grounding plane and the metallic middle frame, a resonant frequency of the planar inverted-F antenna at a low frequency band being adjustable by adjusting a parameter of the adjusting element.

13. The handheld electronic device of claim 12, wherein the adjusting element is an adjustable inductor and the parameter is a coefficient of self-inductance of the adjustable inductor.

14. The handheld electronic device of claim 13, wherein the radiation patch has a first radiation section, a second radiation section and a third radiation section successively connected together to form a U-shaped configuration, the first radiation section being located over the recess and extending along a lengthwise direction thereof, the second radiation section interconnecting ends of the first and third radiation sections away from a top side of the of the grounding plane.

15. The handheld electronic device of claim 14, wherein the planar inverted-F antenna has a first connection section connecting the feed section with the second radiation section and a second connection section connecting the grounding section with the first radiation section, the first and second connection sections are coplanar with the radiation patch.

16. The handheld electronic device of claim 15, wherein the first connection section is straight and the second connection section is L-shaped.

17. The handheld electronic device of claim 13, wherein the recess has a length of 30 mm, a distance between the adjustable inductor and the top side of the grounding plane is 15 mm, and the coefficient of self-inductance of the adjustable inductor is 2.6 nH.

18. The handheld electronic device of claim 17, wherein the inverted planar-F antenna has a first resonant frequency at a low frequency band of 2.4 GHz, and a second resonant frequency at a high frequency band of 5.15-5.85 GHz.

19. The handheld electronic device of claim 17, wherein the metallic middle frame has a slit located near a top end of the recess and communicating therewith.

20. The handheld electronic device of claim 11, wherein the metallic middle frame has a slit located near a top end of the recess and communicating therewith.

21. A dual-band antenna structure for an electronic device having a casing having a metallic middle frame, comprising:

a grounding plane configured to be received in the casing and surrounded by the metallic middle frame, the grounding plane defining a recess in a periphery thereof; and an antenna body electrically coupled to the grounding plane and having a radiation patch;

wherein the radiation patch is in a first plane substantially parallel to and spaced from grounding plane, and the radiation patch is suspended above the grounding plane, the radiation patch has at least a part suspended above the recess;

wherein the antenna body comprises a feed section connecting with the grounding plane, a grounding section connecting with the grounding plane, a first connection section connecting with the feed section, a second connection section connecting with the grounding section;

wherein the radiation patch comprises a first radiation section, a second radiation section and a third radiation section successively connecting with each other;

wherein the first radiation section, the second radiation section, the third radiation section, the first connection section, and the second connection section are coplanar;

wherein the first connecting section is spaced from the first radiation section and the third radiation section, and positioned between the first radiation section and the third radiation section; an end of the first connecting section is perpendicularly connected to the second radiation section, and another end of the first connecting section is spaced from the second connecting section.

22. The dual-band antenna structure of claim 21, wherein the grounding plane is substantially rectangular in shape, and the recess is defined in a corner of the grounding plane.

23. The dual-band antenna structure of claim 22, further comprising an adjusting element received in the recess and configured to electrically couple with the metallic middle frame and the grounding plane, a resonant frequency of the dual-band antenna structure being adjusted by adjusting a parameter of the adjusting element.

24. The dual-band antenna structure of claim 23, wherein the dual-band antenna structure is used for dual-band Wi-Fi wireless communication.

* * * * *